United States Patent [19]

Frew et al.

[11] Patent Number: 4,516,861

[45] Date of Patent: May 14, 1985

[54] HIGH RESOLUTION AND HIGH ACCURACY TIME INTERVAL GENERATOR

[75] Inventors: John W. Frew, Chelmsford; Kenneth W. Robbins, North Reading, both of Mass.

[73] Assignee: Sperry Corporation, New York, N.Y.

[21] Appl. No.: 540,081

[22] Filed: Oct. 7, 1983

[51] Int. Cl.[3] ..... G04F 8/00

[52] U.S. Cl. ..... 368/120; 368/118; 328/55

[58] Field of Search ..... 368/118–120; 328/55

[56] References Cited

U.S. PATENT DOCUMENTS 3,896,378 7/1975 Bedford ..... 368/120

4,124,820 11/1978 Arnstein ..... 328/55

4,288,750 9/1981 Newton et al. ..... 328/55

4,408,895 10/1983 Geesen ..... 368/118

*Primary Examiner*—Bernard Roskoski

*Attorney, Agent, or Firm*—Howard P. Terry; Albert B. Copper

[57] ABSTRACT

A presettable counter and a substantially identical counter both slaved to a crystal-controlled clock oscillator form a programmable slip counter for providing transition signals with a time interval therebetween in accordance with a coarse delay signal preset into the presettable counter. A programmable logic delay line responsive to a fine delay signal delays one of the transitions so as to impart a precise delay interval between the delayed transition signal and the other transition signal.

10 Claims, 1 Drawing Figure

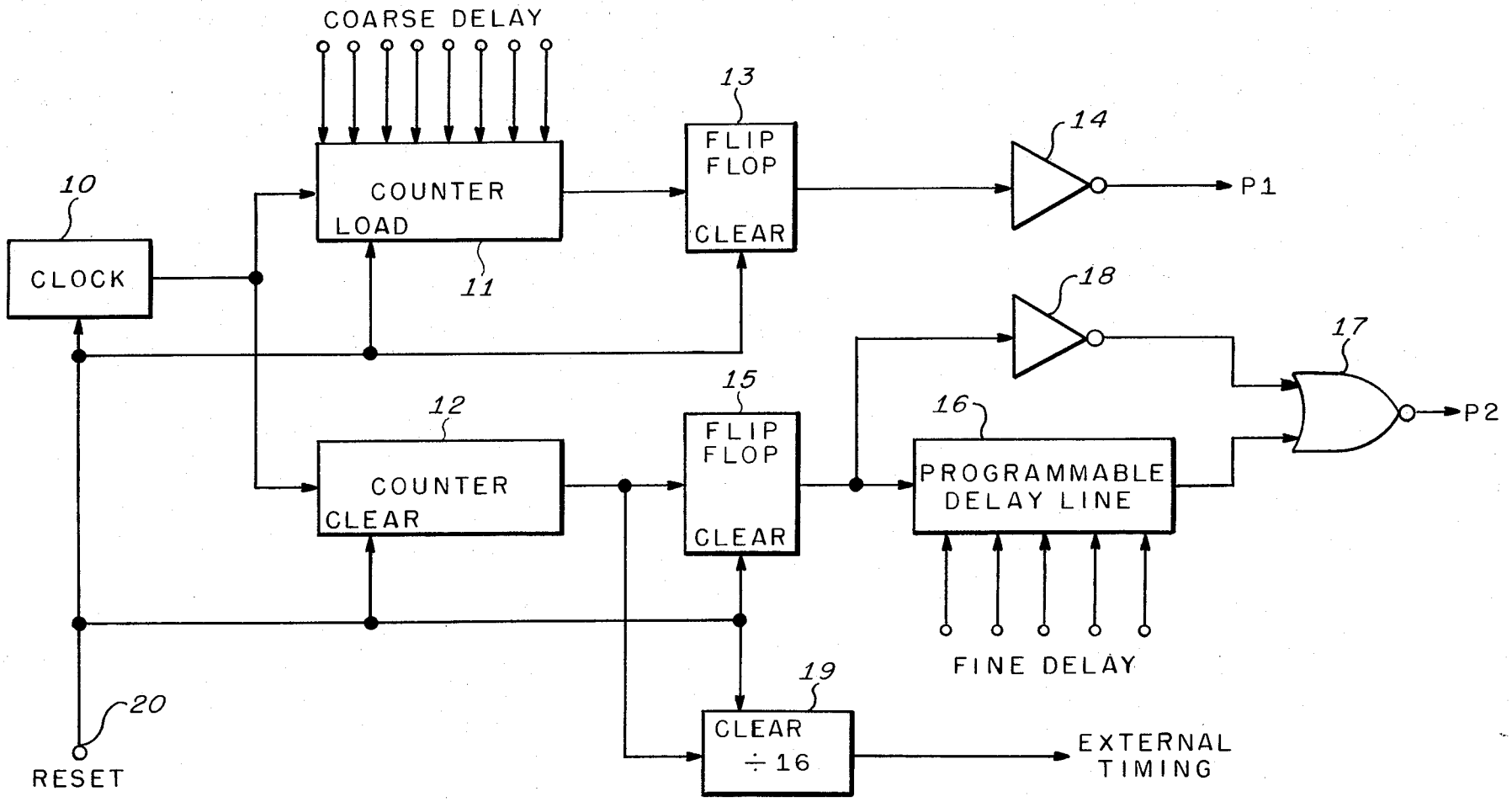
P2
17
P1
14
18
PROGRAMMABLE DELAY LINE
16
FINE DELAY
EXTERNAL TIMING
13
FLIP FLOP
CLEAR
15
FLIP FLOP
CLEAR
19
CLEAR
÷ 16
COARSE DELAY
COUNTER
LOAD
11
12
COUNTER
CLEAR
10
CLOCK
20
RESET

HIGH RESOLUTION AND HIGH ACCURACY TIME INTERVAL GENERATOR

The Government has rights in the invention pursuant to Contract No. F08635-80-C-0231 awarded by the Department of Defense.

BACKGROUND OF THE INVENTION

1. Field of the Invention

The invention relates to time interval generation particularly with respect to generating time intervals to a high precision and with high resolution.

2. Description of the Prior Art

Time interval generation apparatus or time synthesizers that provide high precision are known in the prior art but such devices utilize techniques that result in complex and hence expensive devices. Such high precision time synthesizers are generally utilized as laboratory instruments and involve complex designs utilizing, for example, phase-locked loop circuits or precisely charged capacitors with fast ramp comparators. The circuit complexity of the prior art devices results in excessive circuit cost and a degradation in reliability.

SUMMARY OF THE INVENTION

The present invention provides a relatively simple low cost and reliable programmable precision time interval generation circuit. The invention utilizes a programmable counter preset with a value determinative of a selectable coarse delay and a similar counter that is cleared to a predetermined state, such as zero. Both counters are driven by the same clock source and a coarse delay is provided by the time interval between the overflows of the two counters. The overflow output of one of the counters is processed by a programmable logic delay line to impart a fine delay to the output of the processed counter. The time interval defined by the output of the unprocessed counter and the output of the programmable logic delay line provides the precise time interval of the present invention.

BRIEF DESCRIPTION OF THE DRAWING

The sole FIGURE is a schematic block diagram of a preferred embodiment of the precision time interval generator of the present invention.

DESCRIPTION OF THE PREFERRED EMBODIMENT

Referring to the sole FIGURE, a schematic block diagram of the time interval generator of the present invention is illustrated. The invention provides digitally controlled precision time interval generation for use, for example, in a radar altimeter range measurement system or in devices for sensing the level of liquids. The invention will be exemplified in terms of a device providing an accuracy of ±1 nanosecond (ns) with a resolution of 1 ns over a range of approximately 5 microseconds. The invention effects the precise delay by utilizing a coarse delay with a resolution of 20 ns and a fine delay with a resolution of 1 ns. It is appreciated that the specific parameters provided herein are merely exemplary; other parameters being usable in practicing the present invention.

A 50 MHz crystal-controlled clock 10 provides clock pulses to a programmable counter 11 and to a second counter 12. The counters 11 and 12 are eight-stage binary counters that provide negative-going edges upon attaining full count. The counter 11 may be programmed by a remote controller with an eight-bit binary number for providing a coarse delay adjustment variable in 20 ns increments from 0 to 5.12 microseconds in accordance with the value of the coarse delay preset. The negative-going overflow output of the counter 11 is applied to set a flip-flop 13 which, provides a positive-going edge upon the occurrence of the overflow from the counter 11. The positive-going edge from the flip-flop 13 is inverted by an inverter 14 to provide a negative-going edge designated as P1 which occurs in accordance with the overflow of the counter 11. Therefore, P1 can be caused to occur at coarse delay intervals of 20 ns over the range of 0 to 5.12 microseconds in accordance with the value of the coarse delay preset.

The negative-going edge overflow of the counter 12 is applied to set a flip-flop 15 which provides a corresponding positive-going edge in response thereto. The positive-going edge from the flip-flop 15 is applied to a programmable logic delay line 16 which imparts delay thereto in increments of 1 ns in accordance with a five-bit fine delay signal applied thereto. The programmable logic delay line 16, therefore, may impart, to the positive-going edge imparted thereto from the flip-flop 15, a programmable fine delay in increments of 1 ns over a range of 32 ns. The output of the programmable logic delay line 16 is a positive-going edge delayed from the input positive-going edge by the delay interval selected by the fine delay signal applied as the programming input to the device. Such programmable logic delay lines are commercially available in integrated circuit format from numerous manufacturers of such devices.

The output of the programmable logic delay line 16 is applied through a NOR-gate 17 to provide a negative-going edge delayed from the negative-going edge P1 in accordance with the coarse delay signal applied to the counter 11 and the fine delay signal applied to the programmable logic delay line 16. The positive-going edge output from the flip-flop 15 is also applied as an input to the NOR-gate 17 via an inverter 18. Thus, the output from the NOR-gate 17, designated as P2, is a positive-going edge corresponding to the input to the programmable logic delay line 16 and the negative-going edge resulting from the output from the programmable logic delay line 16. A signal utilized for external timing may be derived from the overflow output of the counter 12 via a −16 circuit 19. The external timing signal therefor is a clock of 12.2 KHz.

A reset signal applied to a terminal 20 is provided to the clock 10 for inhibiting the clock when the reset pulse is applied. The reset pulse also effects clearing the counter 12 and the −16 circuit 19 to zero as well as clearing the flip-flops 13 and 15 to their reset state. The reset signal also effects loading the counter 11 with the coarse delay signal. The minimum practical delay between reset pulses is determined by the number of stages of counter 12.

The counter 12 and the programmable counter 11 slaved to the same 50 MHz crystal-controlled clock oscillator 10 is known as a programmable slip counter. Thus, the coarse delay is effected by the programming input into the programmable slip counter while the fine delay is controlled by the fine delay input into the programmable logic delay line 16. By altering the starting count preloaded into the counter 11 via the coarse delay signal, the output negative transitions can be adjusted in precise 20 ns steps relative to each other. When a coarse delay signal other than zero is loaded into the counter 11, a negative-going edge is provided to the flip-flop 13 before the flip-flop 15 receives a negative-going edge from the counter 12. Thus, P1 is generated prior to the negative-going edge of P2 and this coarse delay can be varied in 20 ns steps from 0 to 5.12 microseconds by applying the appropriate value of coarse delay to the counter 11. Thus, as the magnitude of the coarse delay preset is increased, P1 is generated earlier relative to P2.

Vernier delay is obtained utilizing the programmable logic delay line 16 which provides delays in 1 ns steps in response to the five-bit digital fine delay control signal. The magnitude of the fine delay input signal controls the fine delay adjustment between P1 and P2 in 1 ns steps. As previously explained, P2 comprises a positive transition from the output of the flip-flop 15 followed by a negative transition resulting from the output from the programmable logic delay line 16 propagated through the NOR-gate 17. P1 to P2 timing for fine delay adjustments in 1 ns steps is referenced to the negative transition of P2 which can be delayed relative to the positive transition thereof in 32 steps of 1 ns each. The positive transition of P2 is fixed in time relative to P1 for a predetermined value of coarse delay and may be varied by integral number of clock cycles from the clock 10.

Thus, as the coarse delay signal is increased, P1 is generated earlier with respect to the positive transition of P2. As the magnitude of the fine delay signal is increased, the negative transition of P2 is generated later with respect to the positive transition thereof. In this manner, any desired delay between the negative transition of P1 and the negative transition of P2 can be generated in 1 ns steps from 0 to 5.12 microseconds.

A typical application for the present invention is in a short range radar system where the negative transition of P1 is utilized to activate a transmitter and the negative transition of P2 is utilized to sample a target return. With this technique, an accuracy of $\pm 0.5$ feet is attainable. The reset pulse is applied to the terminal 20 each time a P1–P2 delay is required. The external timing from the block 19 might be utilized to generate reset pulses at a repitition rate of 12.2 KHz to energize the radar system for each transmission. The programmable values of coarse and fine delay may conveniently be altered during application of the reset pulse.

It is appreciated that once programmed, the counters 11 and 12 will continually recycle in a fixed delay relationship with respect to each other in response to continuous application of clock pulses thereto. The device of the present invention can also be utilized to provide a continuous train of P1–P2 edges in fixed delay relationship with respect to each other as long as the programming inputs remain unchanged. This may be effected by internally resetting the flip-flops 13 and 15 each cycle. For example, the occurrence of the P1 edge may be utilized to reset the flip-flop 15 and the occurrence of the P2 output may be utilized to reset the flip-flop 13.

The P2 pulse output comprising a positive edge and a negative edge is utilized in the radar system application in which the present invention was incorporated. It is appreciated, however, that the positive edge derived from the input to the programmable logic delay line 16 and appearing in the P2 output via the inverter 18 is not required in obtaining the P1–P2 negative edge to negative edge delay. Thus, in applications of the present invention not utilizing the positive edge in the P2 output, the inverter 18 may be eliminated and the NOR-gate 17 replaced by an inverter. It is further appreciated that the vernier delay provided by the programmable logic delay line 16 may be effected in the P1 branch rather than in the P2 branch. Additionally, if a range greater than 5.12 microseconds is desired, the length of the counters 11 and 12 may be increased and if course delay increments of other than 20 ns are desired, the repetition rate of the clock 10 may accordingly be altered.

As discussed above, the programmable logic delay line 16 is a commercially available integrated circuit provided by numerous manufacturers. For example, the delay line may be obtained from Engineered Components Company of San Luis Obispo, Calif. as part No. PTTLDL-14-1. This particular delay line requires positive-going input edges and provides delayed positive-going output edges. This particular delay line provides a six-bit digital control input, while in the present embodiment, only the five least significant bits are utilized. The delay line has a built-in offset of approximately 14 ns. Thus, this particular delay line provides incremental delays in 1 ns steps from 14 ns to 45 ns. The remainder of the circuit may conveniently be implemented utilizing standard Schottky TTL logic. Conveniently, the 74S Series is employed. For example, the counters 11 and 12 and the frequency divider 19 may be implemented from S197 counter-chips while the flip-flops 13 and 15 may be implemented utilizing S112 flip-flop circuits.

Thus, the present invention provides a simple and inexpensive digital circuit for providing the time interval generation as described where a simple digital interface for microprocessor control in selecting desired delays is provided. With the components described, a setup time for establishing the coarse and fine delay values on the order of 20 ns is provided.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. Time interval generation apparatus, comprising:

a source of clock pulses, first and second counter means coupled to receive said clock pulses, one of said first and second counter means being presettable to a coarse delay value by a coarse delay signal, said first and second counter means providing respective first and second transition signals in response to said clock pulses and separated in time in accordance with said coarse delay signal, and programmable delay means responsive to said second transition signal and to a fine delay signal for delaying said second transition signal in accordance with said fine delay signal, so that said first transition signal is separated in time from said delayed second transition signal by a time interval determined by said coarse and fine delay signals.

2. The apparatus of claim 1, in which each said first and second counter means includes respective first and second flip-flop means responsive to overflow signals from said first and second counter means, respectively, for providing said first and second transition signals in accordance with said respective overflow signals.

3. The apparatus of claim 1, in which said programmable delay means comprises a programmable logic delay line.

4. The apparatus of claim 2, further including an inverter coupled to said first flip-flop means for inverting the polarity of said first transition signal.

5. The apparatus of claim 4, further including:

an inverter coupled to said second flip-flop means for inverting the polarity of said second transition signal, and a NOR-gate coupled to said programmable logic delay line and said inverter for NORing said inverted second transition signal and said delayed second transition signal.

6. The apparatus of claim 1, in which said source of clock pulses comprises a crystal-controlled oscillator.

7. The apparatus of claim 3, in which said programmable logic delay line comprises an integrated circuit programmable logic delay line.

8. The apparatus of claim 1, in which said presettable one of said first and second counter means comprises said first counter means.

9. The apparatus of claim 1, in which each said first and second counter means comprises a binary counter.

10. The apparatus of claim 2, including reset means for loading said presettable one of said first and second counter means, clearing the other of said first and second counter means, clearing said flip-flop means and disabling said source of clock pulses.

* * * * *